United States Patent [19]

Goetz

[11] 4,198,446

[45] Apr. 15, 1980

[54] APPARATUS FOR THE MANUFACTURE OF A DUAL COATED MANIFOLD SHEET WITH PRESSURE-RUPTURABLE MATERIALS

[75] Inventor: William J. Goetz, Appleton, Wis.

[73] Assignee: NCR Corporation, Dayton, Ohio

[21] Appl. No.: 877,651

[22] Filed: Feb. 14, 1978

[51] Int. Cl.[2] ..... B41M 5/00

[52] U.S. Cl. ..... 427/150; 118/117; 118/122; 118/224; 118/225; 118/226; 118/227; 118/248; 118/249; 118/255; 427/152; 427/211; 427/358; 427/361; 427/365; 427/428

[58] Field of Search ..... 427/150, 152, 211, 361, 427/365, 209, 428, 359, 358; 118/122, 123, 111, 117, 224-227, 248, 249, 255

[56] References Cited

U.S. PATENT DOCUMENTS

| | | | |
|---|---|---|---|
| 3,632,378 | 1/1972 | Busch | 427/150/ |
| 3,899,615 | 8/1975 | Wallsten | 427/211 |
| 3,936,573 | 2/1976 | Brockett | 427/150 |
| 4,085,237 | 4/1978 | Kawakami et al. | 427/150 |

FOREIGN PATENT DOCUMENTS

| | | | |
|---|---|---|---|
| 46-2761 | 1/1971 | Japan | 427/211 |
| 1330379 | 7/1973 | United Kingdom | 427/152 |
| 1361996 | 7/1974 | United Kingdom | 427/152 |

OTHER PUBLICATIONS

Booth, George L., "Coating Equipment and Processes", Lockwood Pub. Co., Inc., 1970, pp. 163-172.

*Primary Examiner*—Ronald H. Smith
*Assistant Examiner*—Janyce A. Bell
*Attorney, Agent, or Firm*—Birch, Stewart, Kolasch & Birch

[57] ABSTRACT

A method and apparatus for the preparation of a manifold sheet having a relatively smooth, curl-free coating of a reactive composition on one side of a manifold sheet and a relatively smooth curl-free coating of rupturable encapsulated material on the opposite side of the manifold sheet, wherein the coatings are applied simultaneously to both sides of the manifold sheet in a single coating pass and without the application of pressure for smoothing either of the coatings.

14 Claims, 6 Drawing Figures

APPARATUS FOR THE MANUFACTURE OF A DUAL COATED MANIFOLD SHEET WITH PRESSURE-RUPTURABLE MATERIALS

BACKGROUND AND SUMMARY OF THE INVENTION

The present invention relates to the art of coated papers and more particularly to a method and apparatus for the fabrication of a two-side coated manifold sheet in which at least one of the coatings is formulated with a pressure-sensitive material.

The present invention will be described with reference to the manufacture of a manifold sheet adapted for use as an intermediate sheet of a manifold assembly and in which the manifold sheet is sometimes referred to as a colorless carbon. It will be understood that the concepts of the present invention will have application also to the manufacture of other two-side coated paper products in which one or both of the coatings contain materials which are pressure-sensitive such as a coating containing pressure-rupturable capsules.

In U.S. Pat. Nos. 2,712,507, 2,730,456, 2,800,457, 3,996,405, and 4,001,140, reference is made to microcapsular or CB coatings wherein there is contained within the microcapsule a solution of a basic chromogenic material which is to be reacted with an acidic color-activating substance to produce a mark. Separate coatings are provided on suitable carrier sheets in which one of the coatings is formulated to contain a liquid reactant such as a colorless dye component dissolved in a liquid solvent and which is encapsulated in microscopic capsules uniformly distributed throughout the coating (hereinafter referred to as the emulsion coat), while the other coating is formulated of a reactive material, advantageously a phenolic polymer, which is adapted to react with a liquid when released from the capsule to form a colored image (hereinafter referred to as the reactive coat or the clay coat). U.S. Pat. Nos. 3,455,721, 3,672,935, and 3,732,120 are exemplary of the use of phenolic polymers as the reactive material. In addition, the reactive material can be a combination of a zinc compound and a salicylic acid derivative such as defined in U.S. Pat. No. 4,022,936. The reactive component can also be materials such as silton clay, silica gel, attapulgite and the like.

When the coating containing the encapsulated liquid is positioned in surface contact with the reactive coating, no color develops until pressure is applied by pen, pencil, stylus, typewriter key, die impression or the like, or by heat to rupture the capsules in the imaged areas whereby the liquid released from the ruptured capsule wets out the adjacent receptive material in the reactive coating to develop the image.

In addition to the above-named common types of CB coatings, there are also CB coatings where the acidic reactant is contained within the microcapsular coating as disclosd in U.S. Pat. No. 3,894,168. Also, there are color reactant systems which are not based on acid-base chemistry, as shown in U.S. Pat. No. 3,558,341.

In a manifold assembly, the top sheet in the assembly will be fabricated with only its underside coated with the emulsion coat, while the bottom sheet in the assembly will be coated on its top side with only the reactive coating. All of the sheets in between will be coated on the underside with the emulsion coat and on the top side with the reactive coat in a two-side coated sheet.

Since the emulsion coat comprises the most expensive materials and therefore represents the more expensive coating, it is desirable to fabricate the reactive coat with a high degree of surface smoothness so as to be able to make more effective contact with the emulsion coat and maximize the utilization of the encapsulated liquid released from the coating. In the light of the fact that the emulsion coat is sensitive to pressure which might rupture the capsule, it has been the practice to coat the paper first with the reactive coat whereby the latter can be calendered to smooth the coating before application of the emulsion coat.

Prior to the present invention, carbonless paper known as CFB which comprises a sheet of paper with a capsular coating on the back side and a reactive coating on the front side was produced either by applying a single coating to each side in two separate passes through a single side coater or by applying a coating to each side with two coating heads in a subsequent manner on a tandem coater. U.S. Pat. Nos. 3,535,140 and 3,632,378 are exemplary of methods for the manufacture of a dual-coated manifold sheet in tandem in a single coating pass. U.S. Pat. No. 3,535,140 discloses a method of coating a CFB sheet in a continuous operation by first coating one side of a web of paper with a microcapsule slurry by means of an air-knife station, drying the microcapsular slurry coating, coating the opposite side with a clay slurry by means of an air-knife station, and then drying the clay coating. In U.S. Pat. No. 3,632,378, a CFB sheet is coated in a continuous operation by first coating one side of a web of paper with a clay slurry, drying the clay coating, calendering the clay-coated sheet, coating the opposite side with a microcapsule slurry and drying the microcapsular coating. CFB production by either of the above methods results in significant curl and dimensional instability of the coated paper. Although correction apparatus installed prior to the reel is used to reduce these quality defects, the printer continues to have problems with curl and dimensional instability. In addition, the use of two coating heads, two discrete dryers, and correction apparatus necessitates a machine which requires much space and a high capital investment.

According to a known method, described in U.S. Pat. No. 3,489,592, a satisfactory coating result was obtained by guiding the web of material, for example paper, in a substantially vertical direction downwardly through a press nip which is formed between a thin, flexible blade in the form of, for example, a steel blade with a sharp edge and a rotating roller, the space between the blade and the roller forming a dam filled with a coating composition. Immediately after passing through said nip, the paper web is deflected toward the side where the blade is located, so that an angle is formed between the tangent of the roller and the downward passing portion of the web thereby avoiding a film splitting. However, this known method which utilizes the Billblade coater, only permits the use of the same coating compositions on both sides of the paper web. The reasons for this is that the same dam or coating puddle surrounds the paper web and it has been found to be extremely difficult to arrange a suitable device to separate the dam, for example, into two dams, one for each side of the web, so as to permit a coating with different coating compositions on each side of the paper web.

The invention as defined in U.S. Pat. No. 3,489,592, that is, the original Billblade invention, was then modified to allow the application of different coatings to both sides of a sheet, as shown in U.S. Pat. No. 3,899,615. In this patent, a roll with a soft rubber covering forms a pressure nip with a chrome-finished roll such that coating from a puddle is metered onto the surface of the chromed roll. This coating is then transferred to a paper web at the same time that a different coating is metered to the opposite side of the paper web by a blade. The generally used coating compositions with this method and apparatus are a starch solution metered from the puddle formed between the pressure nips of the soft rubber roll and the chrome roll and a clay coating formed as a puddle between the blade and the rubber-covered backing roll.

Although a reactive coating can be applied successfully on the blade side of the above system, the roll side is unsuitable for the application of capsular coatings. This is true for three reasons:

(a) The pressure nip formed between the rolls does not allow enough coating to be transferred to the web;

(b) A poor pattern occurs on the web because of film splitting at the nips formed by the rolls; and (c) The capsules are damaged by the pressure nips.

British Pat. No. 1,361,996 discloses a process for making CFB paper and printing an ink image, all in one pass in a single machine. The methods of application of both the microcapsular and reactive slurries are both film-coating stations wherein the films are applied in sequence with an intermediate drying after each application. The apparatus in the British Patent has etched or anilox rolls in each of the application stations.

Capsular coatings have been successfully applied to a paper web with a flexographic press which utilizes an anilox roll. An anilox roll is a chrome-covered roll which has precisely machined cells below its surface which will carry a volume of coating after extra material is completely removed from the roll's surface. With the use of an anilox roll, a uniform, well-regulated amount of coating can be applied to a paper web with no damage to the capsules. However, nowhere in the prior art can there be found any method or apparatus wherein a manifold sheet having a relatively smooth, curl-free coating of a reactive composition on one side and a relatively smooth, curl-free coating of rupturable encapsulated material on the opposite side can be produced by simultaneously coating both sides of the manifold sheet in a single coating pass without the application of pressure for smoothing either of the coatings.

Accordingly, it is an object of the present invention to provide a method and apparatus for producing a two-side coated paper of the type described wherein the coatings are sufficiently smooth and uniform throughout the surface of the sheet and wherein the coated sheet is relatively free of curl and dimensional instability so as to lie flat in the manifold assembly.

Another object of the present invention is to provide a method and apparatus for simultaneously coating both sides of a manifold sheet wherein the use of one of the coating heads, one of the discrete dryers and the correctional apparatus can be substantially eliminated, thereby substantially reducing the space requirements and high capital investment.

A further object of the present invention is to provide an improved method and apparatus for simultaneously coating both sides of a manifold sheet wherein one of the coatings is a rupturable encapsulated material which can be applied to one of the sides of said manifold sheet without danger of rupturing said capsular coating.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

Pursuant to the present invention, the above-identified deficiencies can be eliminated and an effective method and apparatus for simultaneously coating a manifold sheet with a capsular coating on one side and a reactive coating on the other side thereof can be achieved by combining the technology of the flexographic press and the Billblade coater. Thus, a coating containing capsules is puddled into a nip formed by a rubber-covered metering roll and an anilox roll. The rubber roll runs at a much slower speed than the anilox roll in order to remove any coating from the surface of the anilox roll which is not contained in the cells of the anilox roll. Preferably, a doctor blade operatively associated with the surface of the anilox roll can also be used for this purpose. A rubber-covered backing roll is then provided for removing the coating from the cells at the nip that it forms with the anilox roll and the capsular coating is then subsequently transferred to the back of a paper web at the same time that a reactive coating is metered onto the other side of the paper web by a backing blade. This results in a uniform application of coatings to both sides of the web with no capsule damage. By proper selection of the cell size in the anilox roll, sufficient CB coating can be applied to produce a satisfactory carbonless paper which has no curl or dimensional instability.

The present invention is also effective when starch is applied with the anilox roll and a reactive coating is applied with a backing blade since it allows much greater latitude in the amount of starch applied such that no curl exists on the CF paper. In addition, the CB coating can be applied on the anilox roll side of the web and starch can be applied on the blade side of the web, and again, the starch application can be controlled such that no curl exists in the paper after drying.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
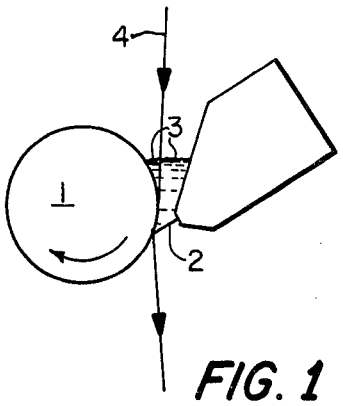
FIG. 1 shows the operation of a Billblade coater which applies the same coating to both sides of a paper web.

The present invention will now be more specifically defined in connection with the accompanying drawings wherein FIG. 1 is representative of the Billblade coater which forms a part of the prior art. In the Billblade coater, the backing roll 1 supports a blade 2 such that a proper amount of coating can be metered onto both sides of a paper web 4 after it passes through a coating puddle 3. Because the web leaves the backing roll at the point of blade contact, a smooth coating application can be realized on both sides of the sheet. However, since the web passes through a coating puddle, the coating on both sides of the sheet is necessarily identical.

Figure 2:
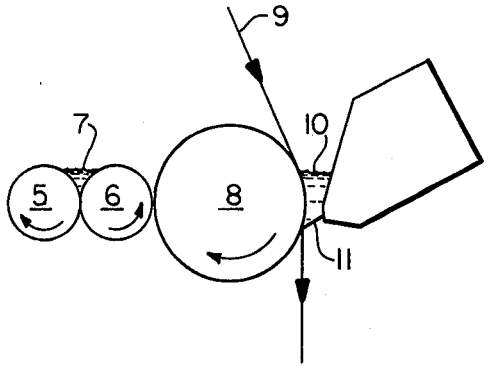
FIG. 2 shows the Billblade coater of FIG. 1 which is modified to allow the application of different coatings to both sides of a paper sheet.

The original Billblade coater was then modified to allow the application of different coatings to both sides of a sheet as seen in FIG. 2. In FIG. 2, a roll with a soft rubber covering 5 forms a pressure nip with a chrome-finished roll 6 such that a coating from a puddle 7 is metered onto the surface of the chromed roll. This coating is then transferred to a rubber-covered backing roll 8 at a pressure nip between the two rolls. The coating on the backing roll is then transferred to the paper web 9 at the same time that a different coating 10 is metered to the opposite side of the paper web by blade 11. The generally used coating composition with this apparatus is a starch solution from puddle 7 and a clay coating from puddle 10. Although the reactive coating has been successfully applied on the blade side of FIG. 2, the roll side was found to be unsuitable for the application of capsular coatings. This is true for three reasons:

(a) The pressure nip formed by rolls 5 and 6 does not allow enough coating to be transferred to the web;

(b) A poor pattern occurs on the web because of film splitting at the nips formed by rolls 5 and 6 and by rolls 6 and 8; and (c) The capsules are damaged by the pressure nips.

Figure 3:
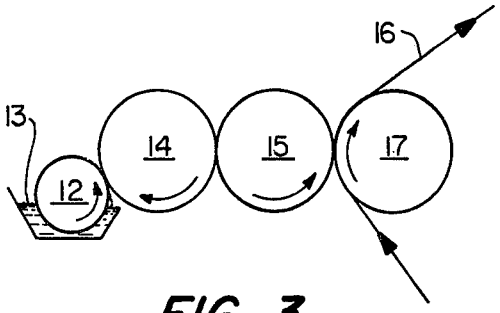
FIG. 3 shows the use of a flexographic press for applying capsular coatings to a paper web.

Capsular coatings have been applied successfully to a paper sheet with the use of a flexographic press as shown in FIG. 3. This unit comprises a rubber-covered fountain roll 12 rotating in a puddle of coating 13 which applies and meters coatings to an anilox roll 14. The anilox roll is a chrome-covered roll which has precisely machined cells disposed below its surface which carry a volume of coating. Extra material is completely removed from the roll's surface. The coating in the cells is transferred at a nip to the surface of a rubber-covered transfer roll 15 and is subsequently transferred to the paper web 16 as the paper passes over the backing roll 17. In this manner, a uniform, well regulated coating can be applied to the paper web with no damage to the capsule since no pressure nip exists prior to the application of the coating to the web.

According to the present invention, an improved method and apparatus have been developed for simultaneously applying capsular and reactive coatings to opposite sides of a manifold sheet to produce carbonless paper. In referring to FIG. 4, a new and improved process and apparatus have been developed which bears a relationship in principle to the flexographic press and to the Billblade coater with metering rolls. The process of the present invention was developed because, although the Billblade coater can be used to simultaneously apply coatings to both sides of a paper web, its metering rolls cannot be effectively used to apply capsular coatings because of insufficient coat weight, application pattern and capsule damage. The relationship of the process of the present invention to the flexographic unit is apparent since both units employ a pickup-metering roll, an anilox roll, and a rubber-plate roll. However, the flexographic unit employs a backing roll while the present process employs a backing blade. The relationship of the present process to the Billblade coater is also apparent insofar as the basic principles of simultaneous application remain while the use of an anilox roll allows successful application of capsule coatings.

Figure 4:
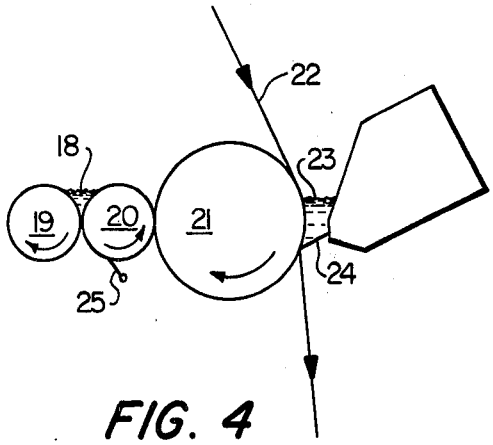
FIG. 4 shows an apparatus according to the present invention which combines the technology of the flexographic press and the Billblade coater so that a capsular coating and a reactive coating can be applied simultaneously to both sides of a paper web.

In order to apply both a capsular coating and a reactive coating simultaneously to a paper web, specific reference is made to FIG. 4 where a coating containing capsules, stilt starch and adhesive is puddled 18 into the nip formed by a rubber-covered metering roll 19 and an anilox roll 20. The rubber-covered roll 19 runs much slower than the anilox roll in order to remove any coating from the surface of the anilox roll which is not contained in the cells. Preferably, a doctor blade 25 operatively associated with the surface of the anilox roll can also be used for this purpose. A rubber-covered backing roll 21 then removes the coating from the cells at the nip it forms with the anilox roll and subsequently transfers the capsular coating to the paper web 22 at the same time that the reactive coating 23 is metered onto the opposite side of the web by the backing blade 24. This results in a uniform application of coating to both sides of the web with no capsule damage. By proper selection of cell size in the anilox roll, sufficient CB coating can be applied to ensure a satisfactory carbonless paper which has no curl or dimensional instability.

Thus, the process and apparatus of the present invention shown in FIG. 4 comprises a color-metering roll, an anilox roll, a rubber-plate roll, and a backing blade. This system allows the simultaneous application of capsular and reactive coating to both sides of a paper web, capsular coating and starch coating to both sides of a paper web, or a starch coating and a reactive coating to both sides of a paper web, as desired.

Figure 5:
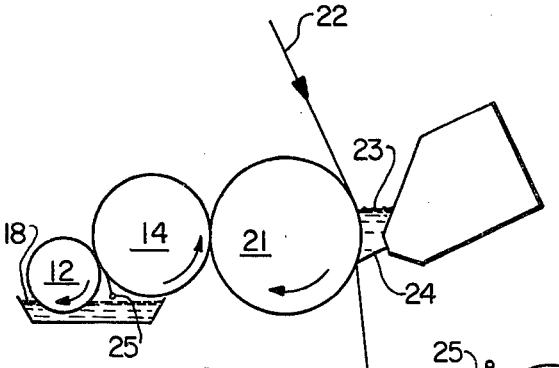
FIG. 5 shows, as another embodiment of the present invention, a fountain roll arrangement in combination with an anilox roll and a backing roll for applying a capsular coating to one side of a paper web, together with a Billblade coater for applying a reactive coating to the other side of the paper web.

FIG. 5 shows a further embodiment of the present invention wherein a rubber-covered fountain roll 12 rotating in a puddle of coating 18 containing capsules, stilt starch and adhesive applies and meters the coating to an anilox roll 14. The coating collected in the cells is transferred at a nip to the surface of the rubber-covered roll 21. The rubber-covered roll 21 then removes the coating from the cells at the nip it forms with the anilox roll and subsequently transfers the capsular coating to the paper web 22 at the same time that the reactive coating 23 is metered onto the opposite side of the web by the backing blade 24.

Figure 6:
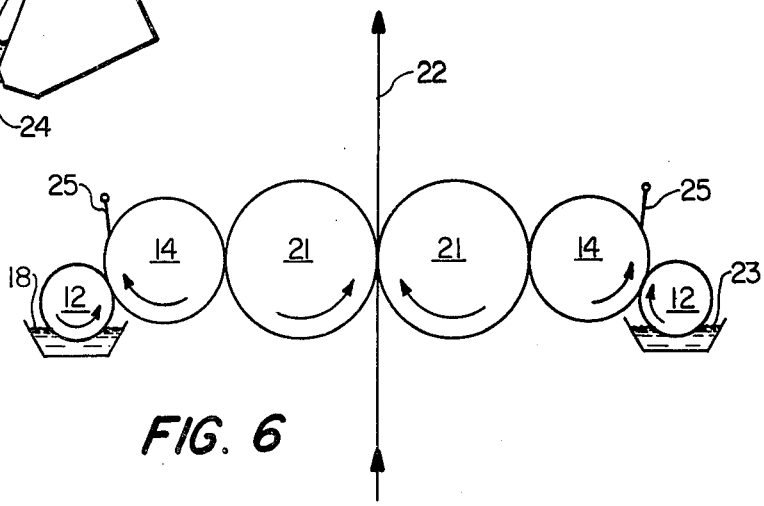
FIG. 6 shows an embodiment wherein the reactive coating and the capsular coating are applied simultaneously to both sides of the paper web using the fountain roll system of FIG. 3 or 5.

FIG. 6 represents still a further embodiment of the present invention wherein the backing blade method of applying the reactive coating in FIG. 5 is replaced by the method wherein a rubber-covered fountain roll 12 rotating in a puddle of reactive coating 23 applies and meters coatings to an anilox roll 14. The coating collected in the cells is transferred at a nip to the surface of the rubber-covered transfer roll 21. The rubber-covered roll 21 then removes the coating from the cells at the nip it forms with the anilox roll and subsequently transfers the reactive coating to the paper web 22 at the same time that a coating containing capsules, stilt starch and adhesive 18 is applied in a similar fountain-type roll arrangement to the opposite side of web 22.

The paper to be treated in accordance with the process and apparatus of the present invention is paper raw stock, such as 13-pound (basis weight per 1300 square feet) manifold bond which is supplied in the form of rolls mounted for free rotational movement on a spindle. The procedure which is used to convey the paper web to coating operation of the present invention and for subsequently drying and collecting the coated paper web can be any procedure known in the prior art such as that disclosed in the above-mentioned patents, particularly U.S. Pat. No. 3,535,140. However, in view of the simultaneous coating feature of the present invention, it is necessary to utilize only one coating head and only one drier and, furthermore, since the present process substantially eliminates curl and dimensional instability, it is not necessary to provide correction apparatus. Thus, the prior art systems must be modified accordingly. It is readily apparent that the method and apparatus developed by the present invention offers a substantial reduction in both space and capital investment, while at the same time providing a fast, efficient, and effective method of simultaneously coating both sides of a paper web wherein at least one of the coatings is a rupturable, encapsulated material.

Briefly described, the capsular or emulsion coating is formulated of an aqueous composition containing rupturable, microscopic capsules made according to the process of U.S. Pat. No. 4,001,140. There may be included within the emulsion coating composition a binder material and a substantial amount of an uncooked granular starch stilt material as disclosed in British Pat. No. 1,252,858 suspended with the rupturable microcapsules. For a more detailed description of the emulsion coating, reference is made to examples in U.S. Pat. No. 4,001,140, and other patents heretofore set forth.

The reactive coating preferably comprises an aqueous system having a metal-modified phenolic resin reactive with the dyes, kaolin clay and other additaments and binder material. Such a coating is disclosed in U.S. Pat. No. 3,732,120.

While the concepts of the present invention define their best use in the simultaneous coating of a paper web with a capsular coating and a reactive coating in a single coating pass, it will be apparent that many of the advantages and improvements of the present invention will be effective when starch is applied with the anilox roll and the reactive coating is applied with a blade since this allows a much greater latitude in the amount of starch applied such that no curl will exist on the CF paper. In addition, CB coating can be applied on the anilox roll side of the web and starch can be applied on the blade side of the web and again the starch application can be controlled such that no curl exists in the paper after drying.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of producing a carbonless manifold sheet having relatively uniform coatings on opposite sides of the sheet, one side being coated with an aqueous emulsion containing pressure-rupturable capsules of a liquid color-forming material, and the other side being coated with a reactive coating composition, which comprises applying the aqueous emulsion to an anilox roll, transferring the aqueous emulsion from the anilox roll and then to one side of the paper web, while simultaneously metering a reactive coating onto the opposite side of said paper web, and then drying both coatings at the same time to form a coated sheet substantially free of curl and dimensional instability.

2. The method of claim 1, wherein the anilox roll contains a plurality of cells disposed below its surface which carry a volume of coating material, with excess coating material being removed from the surface of the roll.

3. The method of claim 2, wherein the aqueous emulsion is transferred from the anilox roll to a backing roll which removes the coating from the cells of the anilox roll at the nip that it forms with the anilox roll and the aqueous emulsion containing pressure-rupturable capsules is then subsequently transferred to said one side of the paper web.

4. The method of claim 2, wherein the aqueous emulsion is puddled in the nip formed by a metering roll and said anilox roll.

5. The method of claim 4, wherein the metering roll runs at a slower speed than the anilox roll in order to remove any coating from the surface of the anilox roll which is not contained in the cells of the anilox roll.

6. The method of claim 1, wherein a fountain roll rotating in a puddle of the aqueous emulsion applies and meters said emulsion to the anilox roll.

7. The method of claim 6, wherein the reactive coating is metered onto said opposite side of the paper web by utilizing a fountain roll rotating in a puddle of reactive coating which meters said reactive coating to an anilox roll.

8. The method of claim 7, wherein the reactive coating is transferred from the anilox roll to a backing roll which removes the coating from the cells of the anilox roll at the nip that it forms with the anilox roll and the reactive coating is then transferred to said opposite side of said paper web.

9. An apparatus for simultaneously coating a web with pressure-rupturable capsules of a liquid color-forming material on one side and a reactive material on the other side thereof which comprises a metering roll, an anilox roll and a covered backing roll disposed in side-by-side relationship, said anilox roll being disposed between said metering roll and said backing roll and containing a plurality of cells disposed below its surface, said backing roll being arranged so that the pressure-rupturable encapsulated material is transferred from the anilox roll to the backing roll at the nip formed therebetween, means for bringing one side of said web into contact with said backing roll for coating said side with the pressure-rupturable encapsulated material and means for simultaneously metering a reactive coating to the opposite side of said web at said contact position.

10. The apparatus of claim 9, wherein the metering means is a backing blade.

11. The apparatus of claim 9, wherein means are provided for drying both sides of the web simultaneously.

12. The apparatus of claim 9, wherein the metering roll and the anilox roll are arranged to form a puddle of the pressure-rupturable encapsulated material in the nip formed by said metering roll and said anilox roll.

13. The apparatus of claim 9, wherein the metering roll is a fountain roll rotating in a puddle of the pressure-rupturable encapsulated material, said fountain roll applying and metering said material to the anilox roll.

14. The apparatus of claim 9, wherein the metering means for applying the reactive coating to the opposite side of said web comprises a fountain roll rotating in a puddle, an anilox roll and a covered backing roll disposed in side-by-side relationship, said anilox roll being disposed between said fountain roll and said backing roll and containing a plurality of cells disposed below its surface, said backing roll being arranged so that the pressure-rupturable encapsulated material is transferred from the anilox roll to the backing roll at the nip formed therebetween.

* * * * *